United States Patent [19]

Hosking

[11] 4,383,198

[45] May 10, 1983

[54] FUEL INJECTION SPARK PLUG

[76] Inventor: John H. Hosking, 451 Sunset Dr., Oakville, Ontario, Canada, L6L 3N3

[21] Appl. No.: 271,348

[22] Filed: Jun. 8, 1981

[51] Int. Cl.[3] ..... H01T 13/02

[52] U.S. Cl. ..... 313/120; 313/143

[58] Field of Search ..... 313/120, 143

[56] References Cited

U.S. PATENT DOCUMENTS

| | | | |
|---|---|---|---|
| 1,266,205 | 5/1918 | Brock | 313/120 |
| 1,525,073 | 2/1925 | Fontenot | 313/120 X |
| 1,536,065 | 5/1925 | Billings | 313/120 |
| 1,555,718 | 9/1925 | Schroeder | 313/120 X |
| 1,771,400 | 7/1930 | Daubenspeck | 313/120 X |
| 2,070,708 | 2/1937 | Brokaw | 313/120 |

*Primary Examiner*—Palmer C. Demeo

*Attorney, Agent, or Firm*—Arne I. Fors; Robert F. Delbridge

[57] ABSTRACT

A fuel injection spark plug for use in combination with an external source of pressurized gaseous fuel such as hydrogen or natural gas supplied to an internal combustion engine is disclosed. The spark plug comprises a peripheral plenum surrounding or integral with the metallic shell in communication with the interior of the shell for the discharge of the fuel through a plurality of longitudinal equispaced slots formed in the spark plug insulating body and valve means provided in a conduit for supplying the fuel to the spark plug, said valve means located remote from the spark plug for permitting the flow of gaseous fuel towards the spark plug while preventing the flow of gaseous combustion products in a direction away from the spark plug. The conduit embodies cooling means for cooling the conduit and gaseous fuel and combustion products contained therein to avoid premature ignition and detonation of the gaseous fuel supplied through the spark plug.

9 Claims, 5 Drawing Figures

FUEL INJECTION SPARK PLUG

BACKGROUND OF THE INVENTION

This invention relates to spark plugs and, more particularly, relates to a fuel injection spark plug for use in combination with an external source of pressurized fuel for supplying gaseous fuel to an internal combustion engine.

It is known to feed a gaseous fuel such as hydrogen gas to an internal combustion engine at points in proximity to each engine spark plug using individual feed lines for each cylinder. U.S. Pat. No. 1,536,065 discloses a spark plug structure having radial openings in combination with a jacket ring for introducing a gaseous fuel for self cleaning of a spark plug.

U.S. Pat. No. 1,525,073 shows a spark plug having means for feeding exhaust gasses from the exhaust manifold of an engine to the spark plugs in order to selectively clean the points of the spark plug.

U.S. Pat. No. 1,445,655 shows a spark plug having means for feeding gaseous fuel such as acetylene or acetylene mixed with air to an engine to assist in the starting of the engine.

SUMMARY OF THE INVENTION

Combustible gaseous fuels such as hydrogen gas and hydrogen and oxygen gaseous mixtures ignite very easily and a hot spark plug electrode or porcelain body can cause premature ignition and combustion of the fuel. It is an important object of the present invention to provide means in combination with a novel fuel injection spark plug structure for cooling the gaseous fuel and combustion products in proximity to the spark plug to obviate hot spots on spark plugs and thus avoid premature ignition and detonation.

It is another object of the present invention to provide a novel fuel injection spark plug and gas feed assembly which is simple in construction and substantially trouble-free in operation.

Another object of my invention is the provision of a novel spark plug and gas feed assembly which will permit injection of a gaseous fuel such as hydrogen or natural gas as a switch-over fuel to a conventional internal combustion engine supplied with propane or with gasoline or gasohol by conventional carburetion.

The spark plug of my invention comprises, in general, an elongated insulating body having an electrode extending axially therethrough and projecting from each end of the insulating body; a circumferential shoulder formed on said insulating body in proximity to one end thereof, said end of the insulating body being tapered from the shoulder to adjacent the projecting end of said electrode; a metallic shell having a hollow threaded end for securing said spark plug in a combustion chamber opening, said shell adapted to receive and envelop the shoulder, a portion of the insulating body adjacent the shoulder and the tapered end of the insulating body, said metallic shell having a peripheral plenum in communication with the interior of the shell; a plurality of substantially longitudinal equispaced slots formed across at least a portion of the shoulder defining passages with the metallic shell to permit a gaseous fuel to flow from said plenum through the slots to the tapered end of the insulating body and through the hollow threaded end of the shell; a conduit for supplying a gaseous fuel under pressure to said plenum; and valve means provided in said conduit remote from said spark plug for permitting the flow of gaseous fuel towards said spark plug while preventing the flow of gaseous combustion products in a direction away from the spark plug.

In a preferred embodiment of my invention, said conduit embodies cooling means therein for cooling said conduit and gaseous fuel and combustion products contained therein.

DESCRIPTION OF THE DRAWINGS

The foregoing and other objects of the invention will become apparent from the following detailed description of the drawings, in which.

DESCRIPTION OF THE PREFERRED EMBODIMENTS

Figure 1:
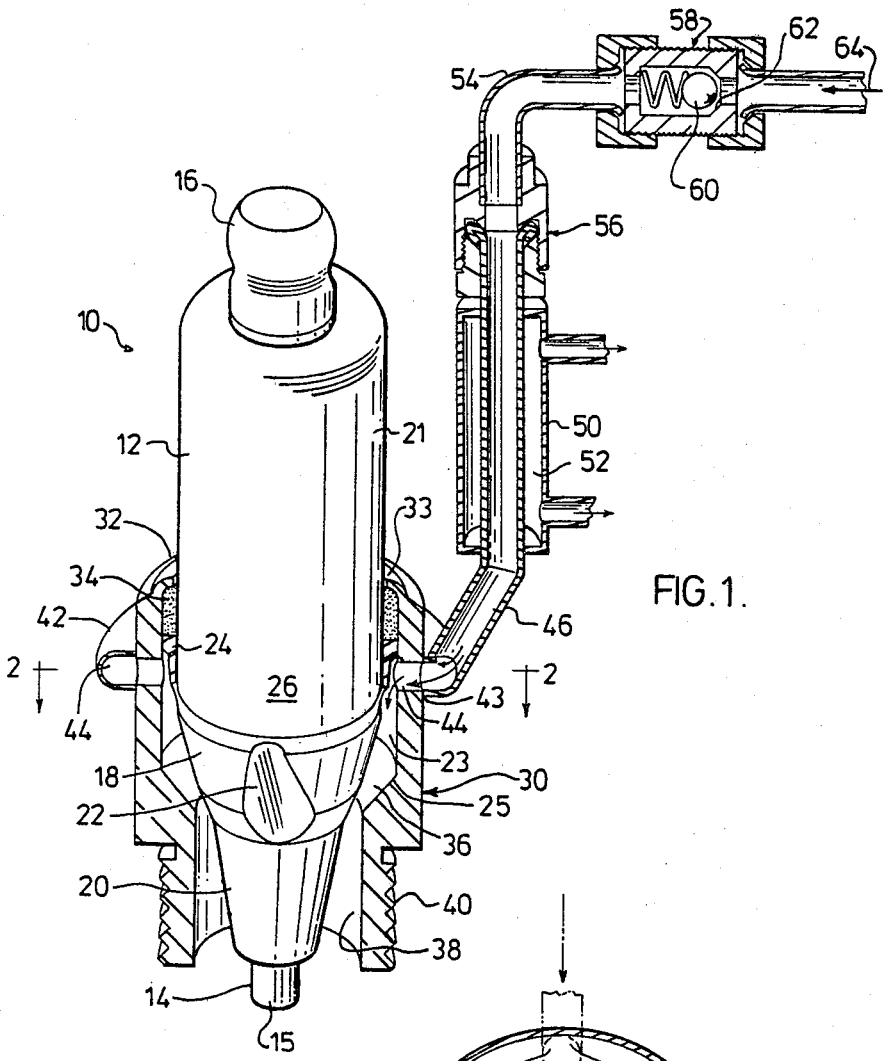
FIG. 1 is a perspective view of an embodiment of the spark plug of the present invention including gaseous fuel conduit means.

With reference to FIG. 1, the spark plug designated generally by numeral 10 comprises an elongated insulating body 12 commonly made of porcelain having an electrode 14 extending axially therethrough and projecting from each end of the insulating body. Electrode 14 has, at its upper end as viewed in FIG. 1, a terminal cap 16 for securing an ignition wire, not shown, to the electrode.

A circumferential shoulder 18 is formed on insulating body 12 in proximity to its lower end 20, lower end 20 being tapered from shoulder 18 to the projecting end 15 of the electrode 14. Elongated slots 22, preferably enlarging, i.e. increasing in cross-sectional area toward end 20, and preferably notched to a depth shown most clearly in FIG. 3 to provide a linear extension of the plane of tapered end 20 to substantially the surface 26 of insulating body 12 adjacent shoulder 18, are formed equidistant about shoulder 18 to define supersonic passages with the inner opposed walls 23, 25 of metallic shell 30 for communicating annular space 24 defined by peripheral cavity 27 of spacer ring 26, which surrounds insulating body 12, and the inner wall 23 of metal shell 30 which is concentric with and envelops the lower end of insulating body 12.

The upper end 32 of metallic shell 30 is inwardly swaged at 33, to form a tight connection between metallic shell 30 and insulating body 12. An inert powder seal 34 commonly used in the manufacture of spark plugs is formed between swage 33 and spacer ring 27 to provide a gas-tight connection between shell 30 and insulating body 12.

The inner wall 23 of the opposite end of shell 30 is inwardly off-set by means of bevelled portion 25 to reduce the inner diameter of shell wall 38 and to snugly receive shoulder 18 of insulating body 12. The outer surface of the lowermost end of shell 30 is threaded as depicted by numeral 40 for securing the spark plug in a combustion chamber spark plug opening, not shown.

Annular space 24 is in communication with a plenum ring 42 formed peripherally about metallic shell 30 in gas-tight relation by a plurality of apertures 44, e.g. 3 or 4 apertures, equispaced about shell 30. Elongated conduit 46 formed integral with ring 42, or secured thereto by a weld 43, and normally fabricated from steel tubing, has a fluid-cooled heat exchanger 50 formed about a portion thereof to permit a flow of cooling gas, depicted by arrows 51, to pass through the annulus 52 formed about conduit 46 to cool the conduit and contained gases.

The free end of conduit 46 is secured to conduit 54 by means of threaded connection 56 well known in the art, conduit 54 having a ball check valve 58 assembly, comprising a spring-loaded ball 60 adapted to engage valve seat 62 to permit the ingress of a pressurized gaseous fuel flowing in the direction of arrow 64 but to prevent the egress of combustion products in a direction away from the internal combustion engine upon ignition and combustion of the gaseous fuel with attendant increase of chamber pressure over that of the pressurized fuel supply.

Figure 2:
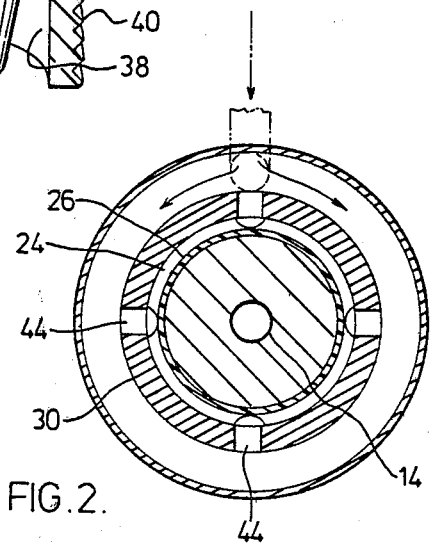
FIG. 2 is a transverse section taken along line 2—2 of FIG. 1.

FIG. 2 taken along line 2—2 of FIG. 1 illustrates in more detail the relationship of plenum ring 42 with the annular space 24 above shoulder 18 of elongated insulating body 26 surrounding central electrode 14. Conduit 46 is shown by ghost lines in the position in which it is connected to ring 42 on the upper side thereof.

Figure 3:
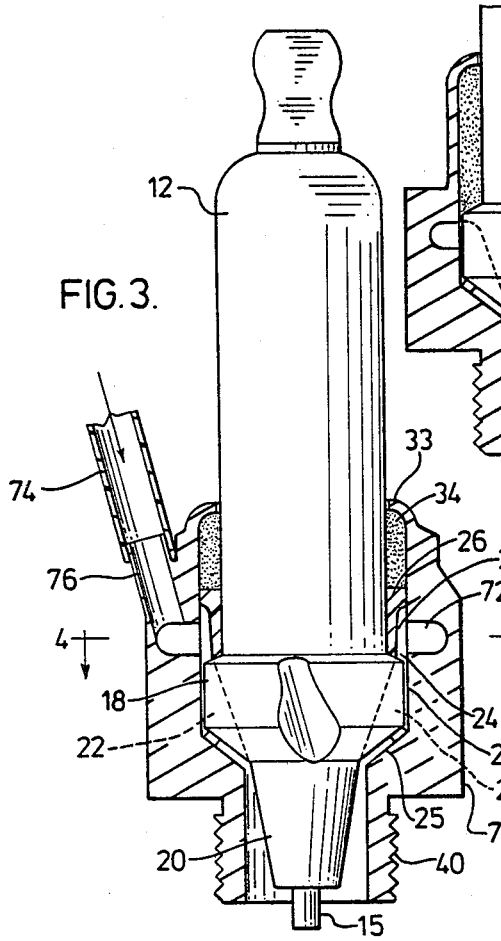
FIG. 3 is a longitudinal section, partly in elevation, of another embodiment of the fuel injection spark plug of the present invention showing an integral plenum assembly.
Figure 4:
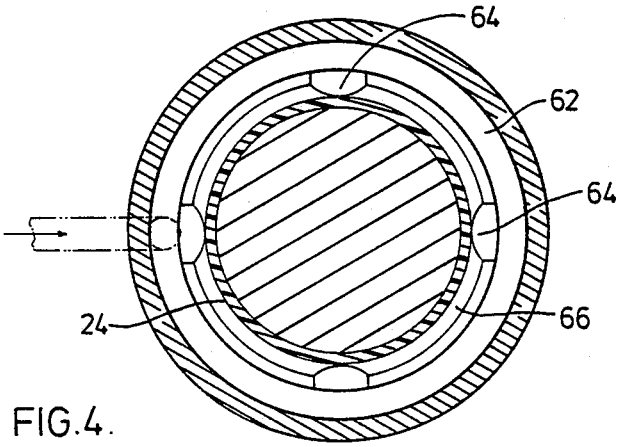
FIG. 4 is a transverse section taken along line 4—4 of FIG. 3.

FIG. 3 illustrates another embodiment of my invention in which elongated cylindrical insulating body 12 has the same configuration as the corresponding body shown in FIG. 1 but metallic shell 70 has an internal peripheral plenum 72 formed therein in continuous communication with annular space 24 defined between peripheral cavity 27. Spacer ring 26 which surrounds insulating body 12, shows more clearly in the section of FIG. 4. Elongated diverging passages formed by slots 22 communicate the annulus formed thereabove with the lowermost tapered portion 20 of body 12.

Fuel conduit 74 threaded or swaged into inlet tube 76 is adapted to supply gaseous fuel to plenum 72 for passage of said fuel into annular space 24 and flow through supersonic slots 22 into the internal combustion engine.

Figure 5:
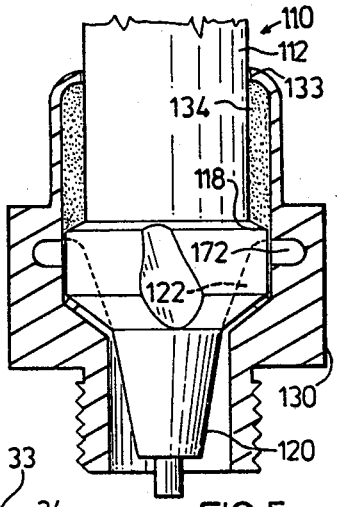
FIG. 5 is a longitudinal section of another embodiment of my invention.

FIG. 5 illustrates another embodiment of my invention in which insulating body 112 of spark plug 110 has a continuous circumferential shoulder 118 formed on insulating body 112 with equispaced slots 122 communicating plenum 172 with the lowermost tapered portion 120 of body 112. Inert powder seal 134 is formed between swage 133 and shoulder 118 to provide a gas-tight connection between shell 130 and insulating body 112. This embodiment of my invention obviates the need for a spacer ring 27.

In use, the spark plugs and gas supply conduits of the present invention can be substituted for spark plugs used in conventional internal combustion engines supplied with a carburetted liquid fuel. The engine can be started and operated with conventional liquid fuels and switched over to or supplemented by a gaseous fuel by the injection of a gaseous fuel through the spark plugs, preferably late in the compression stroke when the cylinders are relatively cool, to avoid pre-ignition due to the presence of cylinder ∓hot spots" with combustion air introduced through the conventional carburetor. The presence of a check valve at locations remote from the spark plug and the use of a fluid-cooled heat exchanger permits cooling of the freshly supplied gaseous combustion fuel and cooling of hot combustion products that may be forced into the conduit by the high pressures created during the combustion stroke of the engine to minimize the formation of hot spots which could cause premature ignition.

What I claim as new and desire to protect by Letters Patent of the United States is:

1. A fuel injection spark plug assembly comprising, an elongated insulating body having an electrode extending axially therethrough and projecting from each end of the insulating body; a circumferential shoulder formed on said insulating body in proximity to one end thereof, said end of the insulating body being tapered from the shoulder to adjacent the projecting end of said electrode; a metallic shell having a hollow threaded end for securing said spark plug in a combustion chamber opening, said shell adapted to receive and envelop the shoulder, a portion of the insulating body adjacent the shoulder and the tapered end of the insulating body, said metallic shell having a peripheral plenum in communication with the interior of the shell; a plurality of substantially longitudinal equispaced slots formed across at least a portion of the shoulder defining passages with the metallic shell to permit a gaseous fuel to flow from said plenum through the slots to the tapered end of the insulating body and through the hollow threaded end of the shell; a conduit for supplying a gaseous fuel under pressure to said plenum; and valve means provided in said conduit remote from said spark plug for permitting the flow of a gaseous fuel towards said spark plug while preventing the flow of gaseous combustion products in a direction away from the spark plug.

2. A fuel injection spark plug assembly comprising, an elongated insulating body having an electrode extending axially therethrough and projecting from each end of the insulating body; a circumferential shoulder formed on said insulating body in proximity to one end thereof, said end of the insulating body being tapered from the shoulder to adjacent the projecting end of said electrode; a metallic shell having a hollow threaded end for securing said spark plug in a combustion chamber opening, said shell adapted to receive and envelop the shoulder, a portion of the insulating body adjacent the shoulder and the tapered end of the insulating body, said metallic shell defining an annular space between the metallic shell and said insulating body adjacent the shoulder on a side of the shoulder away from the tapered end of the insulating body; a plurality of substantially longitudinal equispaced slots formed across the shoulder defining with the metallic shell passages to permit a gaseous fuel to flow from said annular space along the tapered end of the insulating body through the hollow threaded end of the shell; said metallic shell having a peripheral plenum in communication in the annular space for supplying gaseous fuel to the annular space; a conduit for supplying a gaseous fuel under pressure to said plenum; and valve means provided in said conduit remote from said spark plug for permitting the flow of a gaseous fuel towards said spark plug while preventing the flow of gaseous combustion products in a direction away from the spark plug.

3. A fuel injection spark plug assembly as claimed in claim 1 or 2, in which the circumferential shoulder formed on the insulating body has at least three substantially longitudinal equispaced slots formed across the shoulder.

4. A fuel injection spark plug assembly as claimed in claim 1, in which the peripheral plenum for supplying gaseous fuel to the annular space is provided by a plenum ring formed peripherally about the metallic shell, said shell having a plurality of apertures formed equispaced thereabout for communicating the said plenum with the annulus.

5. A fuel injection spark plug assembly as claimed in claim 2 in which the peripheral plenum is formed internally within the metallic shell, said plenum being in continuous circumferential communication with the annular space.

6. A fuel injection spark plug as claimed in claim 5, in which the annular space is formed by a spacer ring mounted on the circumferential shoulder, said spacer ring adapted to seat tightly between the insulating body and metallic shell, said spacer ring having a peripheral cavity for defining the annular space.

7. A fuel injection spark plug assembly as claimed in claim 1, 2 or 5, in which the conduit for supplying the gaseous fuel under pressure to the plenum has a fluid-cooled heat exchanger formed about a portion thereof to permit the flow of a cooling gas over the said portion of the conduit.

8. A fuel injection spark plug assembly as claimed in claim 1, 2 or 5, in which said valve means provided in the conduit remote from the spark plug is a ball check valve for permitting the flow of a gaseous fuel towards the spark plug while preventing the flow of gaseous combustion products in a direction away from the spark plug.

9. A fuel injection spark plug assembly as claimed in claim 1, 2 or 5, in which the conduit for supplying the gaseous fuel under pressure to the plenum has a fluid-cooled heat exchanger formed about a portion thereof to permit the flow of a cooling gas over the said portion of the conduit and in which said valve means provided in the conduit remote from the spark plug is a ball check valve for permitting the flow of a gaseous fuel towards the spark plug while preventing the flow of gaseous combustion products in a direction away from the spark plug.

* * * * *